US008878092B2

(12) United States Patent
Shimizu et al.

(10) Patent No.: US 8,878,092 B2
(45) Date of Patent: Nov. 4, 2014

(54) GAS-INSULATED SWITCHGEAR

(75) Inventors: Yoshinori Shimizu, Tokyo (JP); Hitoshi Sadakuni, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 394 days.

(21) Appl. No.: 13/320,792

(22) PCT Filed: Jun. 25, 2009

(86) PCT No.: PCT/JP2009/061650

§ 371 (c)(1),
(2), (4) Date: Nov. 16, 2011

(87) PCT Pub. No.: WO2010/150390

PCT Pub. Date: Dec. 29, 2010

(65) Prior Publication Data

US 2012/0061352 A1 Mar. 15, 2012

(51) Int. Cl.
*H01H 33/18* (2006.01)
*H01H 33/12* (2006.01)
*H01H 1/38* (2006.01)

(52) U.S. Cl.
CPC ..... *H01H 33/182* (2013.01); *H01H 33/187* (2013.01); *H01H 1/385* (2013.01)
USPC ..... 218/77; 218/76; 218/46

(58) Field of Classification Search
CPC ..... H01H 33/12; H01H 33/18; H01H 33/70; H01H 33/91; H01H 33/64
USPC ..... 218/16–20, 26, 48–50, 65, 74, 146, 147
See application file for complete search history.

(56) References Cited

U.S. PATENT DOCUMENTS 4,500,762 A * 2/1985 Yoshizumi ..... 218/143
4,525,612 A * 6/1985 Kawashima ..... 218/26

(Continued)

FOREIGN PATENT DOCUMENTS

CN 101226846 A 7/2008
EP 0951038 A1 10/1999

(Continued)

OTHER PUBLICATIONS

International Search Report (PCT/ISA/210) issued on Jul. 21, 2009, by Japanese Patent Office as the International Searching Authority for International Application No. PCT/JP2009/061650.

(Continued)

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

A gas-insulated switchgear includes a fixed-side electrode having a tubular fixed-side-conducting contact and a fixed-side shield for housing the fixed-side-conducting contact, and a movable-side electrode having a movable conductor driven by a driving unit to be connected to and separated from the fixed-side-conducting contact, facing each other in a container filled with an insulating gas. The switchgear includes a fixed-side-arc shield in the form of a circular plate, which is made of an arc-resistant member and has an opening of a diameter larger than the outer diameter of the movable conductor, the opening being formed on the side of the fixed-side shield facing the movable-side electrode. The fixed-side-arc shield is formed into a thin plate so as to cause an arc current to flow outward in a radial direction during contact parting of the fixed-side-conducting contact and the movable conductor to generate magnetic flux on a surface thereof in a circumferential direction.

9 Claims, 6 Drawing Sheets

(56) References Cited

U.S. PATENT DOCUMENTS

| | | | | |
|---|---|---|---|---|
| 5,514,844 | A * | 5/1996 | Hamano et al. | 218/57 |
| 6,100,492 | A | 8/2000 | Zehnder et al. | |

FOREIGN PATENT DOCUMENTS

| | | | |
|---|---|---|---|
| GB | 2332566 | A | 6/1999 |
| JP | 60-147126 | U | 9/1985 |
| JP | 2-24927 | A | 1/1990 |
| JP | 3-269922 | A | 12/1991 |
| JP | 11-329176 | A | 11/1999 |
| JP | 2000-67704 | A | 3/2000 |
| JP | 2002-334636 | A | 11/2002 |
| JP | 2002-334637 | A | 11/2002 |
| JP | 2003-187676 | A | 7/2003 |
| JP | 2007-323992 | A | 12/2007 |
| JP | 2008-176942 | A | 7/2008 |
| WO | 99/49488 | A1 | 9/1999 |

OTHER PUBLICATIONS

Written Opinion (PCT/ISA/237) issued on Jul. 21, 2009, by Japanese Patent Office as the International Searching Authority for International Application No. PCT/JP2009/061650.

Notice of Rejection issued in corresponding Application No. JP 2009-546610 dated Dec. 22, 2009 with English translation.

Extended Search Report issued on Dec. 3, 2013 by the European Patent Office, in corresponding European Patent Application No. 09846522.2. (5 pages).

Chinese Office Action dated Jun. 4, 2014 issued in corresponding Chinese Patent Appin. No. 200980160115.4, with English translation (12 pages).

* cited by examiner

GAS-INSULATED SWITCHGEAR

FIELD

The present invention relates to a gas-insulated switchgear used in power plants, substations and others.

BACKGROUND

There is disclosed a conventional gas-insulated switchgear including: a fixed-side main contact and a movable-side main contact that can be connected to and separated from each other; a fixed-side arcing contact that is electrically connected to the fixed-side main contact and fixedly attached to the fixed-side main contact; a movable-side arcing contact that is electrically connected to the movable-side main contact and fixedly attached to a tip end of the movable-side main contact, the movable-side arcing contact being able to be connected to and separated from the fixed-side arcing contact; and a shield for shielding an electric field, the shield being arranged outside the fixed-side main contact and the fixed-side arcing contact, all of which are disposed in a metal container filled with an insulating gas. In this gas-insulated switchgear, the shield for shielding an electric field includes: a support member electrically connected to the fixed-side main contact, the support member having one end fixedly attached to the fixed-side main contact and the other end in which a through hole is formed; an arc-resistant member disposed at the other end of the support member so as to cover a tip end portion of the fixed-side main contact, the arc-resistant member having a convex curved portion formed on a side opposite to the support member and a threaded portion formed on the same side as the support member; and a bolt passing through the through hole of the support member to threadedly engage with the threaded portion of the arc-resistant member, thereby fixing the arc-resistant member to the support member (see Patent Literature 1, for example).

There is also disclosed a gas-insulated switchgear including a fixed-side electrode part and a movable-side electrode part disposed in a container filled with an insulating gas so that they face each other. In the gas-insulated switchgear, the fixed-side electrode part includes: a fixed-side conducting contact in the form of a cylinder; a fixed-side arcing contact disposed at a central portion of the fixed-side conducting contact, the fixed-side arcing contact generating arc during contact parting; and a fixed-side shield disposed around the fixed-side conducting contact, and the movable-side electrode part includes a movable-side contact driven by a driving unit to be connected to and separated from the fixed-side conducting contact. In this gas-insulated switchgear, the fixed-side shield includes an annular fixed-side arc shield provided on a side facing the movable-side electrode part, the fixed-side arc shield having an opening hole with a diameter larger than that of the movable-side contact. Furthermore, a plurality of permanent magnets of the same shape is embedded in a circumferential direction in the vicinity of the opening hole of the fixed-side arc shield (see Patent Literature 2, for example).

CITATION LIST

Patent Literature

Patent Literature 1: Japanese Patent Application Laid-open No. 2003-187676

Patent Literature 1: Japanese Patent Application Laid-open No. 2007-323992

SUMMARY

Technical Problem

The above conventional technique disclosed in Patent Literature 1 includes the arc-resistant member disposed at the other end of the support member so as to cover the tip end portion of the fixed-side main contact, with the convex curved portion formed on the side opposite the support member. This easily attaches an arc to the entire arc-resistant member and possibly attaches the arc to the metal container and causes a problem to increase the outer diameter of the arc-resistant member.

The above conventional technique disclosed in Patent Literature 2 also has the problem that the gas-insulated switchgear requires an expensive arc-resistant member having a large outer diameter and a large wall thickness.

The invention has been made in view of the aforementioned problems. It is an object of the invention to obtain a gas-insulated switchgear at low cost capable of preventing diffusion of an arc and capable of reducing the outer diameter of an electrode.

Solution to Problem

In order to solve the above mentioned problem and achieve the object, a gas-insulated switchgear according to the present invention includes a fixed-side electrode and a movable-side electrode facing each other in a container filled with an insulating gas, the fixed-side electrode including a tubular fixed-side conducting contact and a fixed-side shield that houses the fixed-side conducting contact, the movable-side electrode including a movable conductor driven by a driving unit to be connected to and separated from the fixed-side conducting contact, the gas-insulted switchgear comprising a fixed-side arc shield in the form of a thin circular plate, the fixed-side arc shield having an opening with a diameter larger than an outer diameter of the movable conductor, the opening being formed on a side of the fixed-side shield facing the movable-side electrode, the fixed-side arc shield causing an arc current to flow outward in a radial direction during contact parting of the fixed-side conducting contact and the movable conductor to generate magnetic flux on a surface thereof in a circumferential direction that produces a force acted on an arc in a direction of a central axis, the fixed-side arc shield containing an arc-resistant member for restricting the arc in the vicinity of the opening.

Advantageous Effects of Invention

The gas-insulated switchgear according to the present invention can prevent diffusion of an arc, and reduce the outer diameter of an electrode, and can be produced at low cost.

BRIEF DESCRIPTION OF DRAWINGS

FIG. 1-2 is a partial cross-sectional view showing the detailed shape of a fixed-side arc shield of the gas-insulated switchgear of a first embodiment.

FIG. 1-3 is a partial cross-sectional view of a fixed-side arc shield of a conventional gas-insulated switchgear given as a comparative example.

FIG. 1-4 is a partial cross-sectional view of a fixed-side arc shield of another gas-insulated switchgear given as a comparative example.

FIG. 2 is a cross-sectional view showing a second embodiment of the gas-insulated switchgear according to the present invention.

FIG. 3 is a cross-sectional view showing a third embodiment of the gas-insulated switchgear according to the present invention.

FIG. 4 is a cross-sectional view showing a fourth embodiment of the gas-insulated switchgear according to the present invention.

FIG. 7-1 is a cross-sectional view showing a seventh embodiment of the gas-insulated switchgear according to the present invention.

FIG. 7-2 is a view from the direction of an arrow along line A-A of FIG. 7-1.

DESCRIPTION OF EMBODIMENTS

Embodiments of a gas-insulated switchgear according to the present invention will be described in detail below with reference to the drawings. The embodiments are not intended to limit the invention.

First Embodiment

Figure 1:
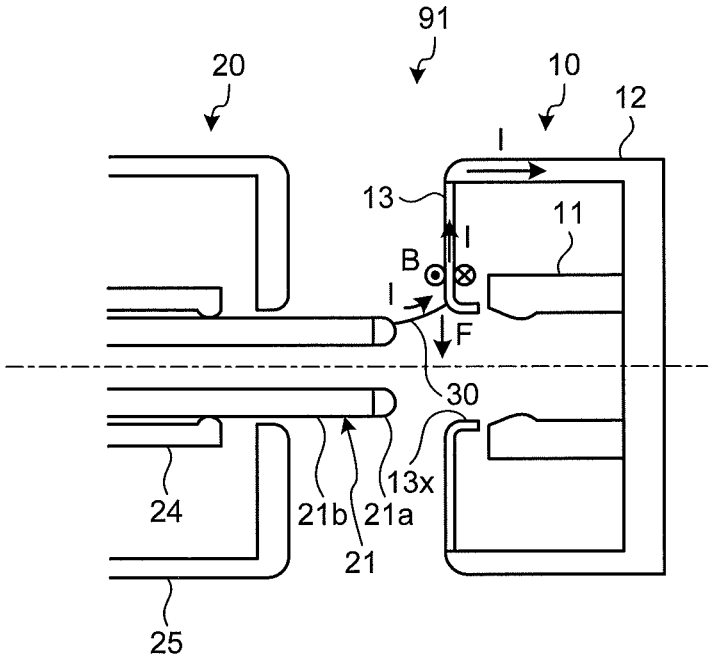
FIG. 1-1 is a cross-sectional view showing a first embodiment of a gas-insulated switchgear according to the present invention.
Figures 1, 2:
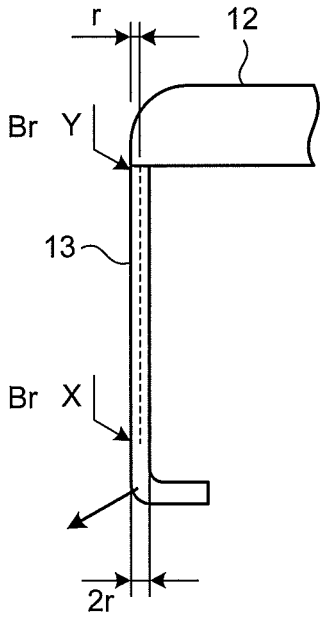
Figures 1, 2, 3:
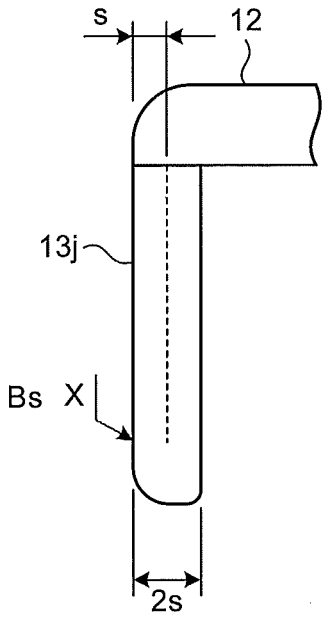

FIG. 1-1 is a cross-sectional view showing a first embodiment of a gas-insulated switchgear according to the present invention. FIG. 1-2 is a partial cross-sectional view showing the detailed shape of a fixed-side arc shield of the gas-insulated switchgear according to a first embodiment. FIG. 1-3 is a partial cross-sectional view of a fixed-side arc shield of a conventional gas-insulated switchgear given as a comparative example. FIG. 1-4 is a partial cross-sectional view of a fixed-side arc shield of another gas-insulated switchgear given as a comparative example.

As shown in FIG. 1-1, a fixed-side electrode 10 and a movable-side electrode 20 of a gas-insulated switchgear 91 for current breaking are disposed in a not-shown container filled with an insulating gas of high arc-extinguishing performance such that they face each other along a drive axis line (central axis line). The fixed-side electrode 10 includes a fixed-side tubular conducting contact 11 made of copper, the fixed-side tubular conducting contact 11 allowing a current to flow through, a cylindrical fixed-side shield 12 made of aluminum, the cylindrical fixed-side shield 12 housing the fixed-side conducting contact 11, and a fixed-side arc shield 13 in the form of a thin circular plate. The fixed-side arc shield 13 is made of an arc-resistant member (such as an alloy of copper and tungsten), and is provided on the side of the fixed-side shield 12 facing the movable-side electrode 20. The fixed-side arc shield 13 and the fixed-side shield 12 are fixed by screwing, brazing or the like. The fixed-side arc shield 13 will be described in detail later.

The movable-side electrode 20 includes a movable conductor 21 driven by a not-shown driving unit to be brought into contact with and be separated from the inside of the fixed-side conducting contact 11, a movable-side tubular conducting contact 24 made of copper, the movable-side tubular conducting contact 24 having the movable conductor 21 inserted therein and allowing a current to flow in the movable conductor 21, and a movable-side shield 25 made of aluminum, the movable-side shield 25 housing the movable-side conducting contact 24. The movable conductor 21 has a tubular sliding contact 21*b* made of copper, and a movable-side arcing contact 21*a* made of an arc-resistant member, the movable-side arcing contact 21*a* fixedly attached to the tip end of the sliding contact 21*b* by brazing and the like.

The fixed-side arc shield 13 will next be described in detail. An opening 13*x* with a diameter slightly larger than that of the movable conductor 21 is formed in a central portion of the fixed-side arc shield 13 in the form of a thin circular plate. The opening 13*x* has the shape of a short cylinder formed by press punching and drawing the central portion of the thin circular plate.

In the gas-insulated switchgear 91 of the first embodiment, the fixed-side arc shield 13 functions to cause an arc current I to flow outward in the radial direction of the fixed-side arc shield 13 in the form of a thin circular plate to generate strong magnetic flux on a surface thereof in a circumferential direction during contact parting of the fixed-side conducting contact 11 and the movable conductor 21, and to cause the magnetic flux to produce a force acted on an arc 30 in the direction of the central axis, thereby restricting the arc 30 in the vicinity of the opening 13*x*.

The arc 30 generated during the contact parting of the fixed-side conducting contact 11 and the movable conductor 21 causes the arc current I to flow outward in the radial direction of the fixed-side arc shield 13. At this time, magnetic flux B in the circumferential direction is generated by the arc current I. The magnetic flux B is directed in a clockwise direction on the front side of the fixed-side arc shield 13 as viewed from the movable-side electrode 20 whereas the magnetic flux B is directed in an anticlockwise direction on the rear side thereof. The magnetic flux B on the front side of the fixed-side arc shield 13 produces a force F acted on the arc 30 in the direction of the central axis, so that the arc 30 can be restricted in the vicinity of the opening 13*x*.

As shown in FIG. 1-2, a magnetic flux density Br at a position X where an arc attaches on a surface of the fixed-side arc shield 13 can be obtained by the following formula (1):

$$Br=\mu_0 I/2\pi r \quad (1)$$

Br: magnetic flux density $\mu_0$: magnetic permeability

I: arc current r: average distance that a current flows to a position where an arc attaches in a plate thickness, being equal to a half the plate thickness of the fixed-side arc shield.

As clearly seen from the formula (1), the magnetic flux density Br becomes higher with smaller plate thickness 2*r* of the fixed-side arc shield 13. Accordingly, the strong force F acts on the arc 30 in the direction of the central axis. In the case of a conventional fixed-side arc shield 13*j* shown in FIG. 1-3 with a large plate thickness 2*s*, a magnetic flux density Bs at a position X where an arc attaches on a surface of the fixed-side arc shield 13*j* becomes lower. In this case, a force for restricting the arc 30 does not act on the arc 30.

A region, in which the average distance r that a current flows to a position Y where an arc attaches is small, can be extended by increasing the diameter of the fixed-side arc shield 13 of a small plate thickness to increase a conducting path length, and by reducing the plate thickness to minimize a cross-sectional area of conduction as shown in FIG. 1-2.

This extends a region where the magnetic flux density Br is high, so that the arc 30 can be restricted in a larger region.

A region of magnetic flux for restricting the arc 30 becomes smaller if a fixed-side arc shield 13*k* with a small plate thickness has a small diameter and a conducting path length is short as shown in FIG. 1-4. Further, as a cross-sectional area of conduction of a fixed-side shield 12*t* shown in FIG. 1-4 increases, an average distance t a current flows to a position Y where an arc attaches increases. In this case, a magnetic flux density Bt becomes smaller, so that the arc 30 cannot be restricted.

Since the arc 30 is restricted in the vicinity of the opening 13*x* in the gas-insulated switchgear 91 of the first embodiment, the plate thickness of the fixed-side arc shield 13 in a region where the arc 30 is restricted is determined in consideration of the amount of wear of an arc-resistant member during designed life span of the gas-insulated switchgear 91 obtained by the following formula (2):

$$V=\alpha\cdot(Is)^{\beta}\cdot t \tag{2}$$

V: amount of wear

Is: breaking current t: arc time

α, β: constant numbers determined by the material used for the fixed-side arc shield 13.

Further, the plate thickness of the fixed-side arc shield 13 around the region where the arc 30 is restricted is determined to be a plate thickness (cross-sectional area of conduction) that can thermally withstand the flow of the arc current I obtained from the following formula (3):

$$A=\sqrt{\frac{8.5\times10^{-6}\times S}{\log_{10}\left(\frac{t}{27.4}+1\right)}}\times I \tag{3}$$

A: cross-sectional area of conduction ($mm^2$) of the fixed-side arc shield 13

I: arc current (A)

S: time (in seconds) when the arc current flows t: permissible increase of temperature (° C.) caused by fusion of arc-resistant member.

As described above, the gas-insulated switchgear 91 of the first embodiment can prevent diffusion of the arc 30. Further, the gas-insulated switchgear 91 can be obtained at low cost by reducing the plate thickness of the fixed-side arc shield 13 made of an expensive arc-resistant member.

Second Embodiment

FIG. 2 is a cross-sectional view showing a second embodiment of the gas-insulated switchgear according to the present invention. As shown in FIG. 2, a gas-insulated switchgear 92 of the second embodiment includes a fixed-side arc shield 13*b* of a shape different from that of the gas-insulated switchgear 91 of the first embodiment. The gas-insulated switchgear 92 does not differ in other respects.

The fixed-side arc shield 13*b* of the second embodiment includes a central portion 13*t*, where the arc 30 attaches, made of an arc-resistant member in which an opening 13*x* is formed, and an annular peripheral portion 13*s*, where the arc 30 scarcely attaches, made of an inexpensive material that is equivalent to the fixed-side shield 12. The peripheral portion 13*s* connects the central portion 13*t* and the fixed-side shield 12. The expensive arc-resistant member is used in a small part of the fixed-side arc shield 13*b* of the second embodiment, so that the gas-insulated switchgear 92 can be produced at lower cost.

Third Embodiment

FIG. 3 is a cross-sectional view showing a third embodiment of the gas-insulated switchgear according to the present invention. As shown in FIG. 3, a gas-insulated switchgear 93 of the third embodiment includes a fixed-side shield 12*c* of a shape different from that of the gas-insulated switchgear 92 of the second embodiment. The gas-insulated switchgear 93 does not differ in other respects.

The fixed-side shield 12*c* of the third embodiment has an outer diameter smaller than that of the fixed-side shield 12 of the first and second embodiments. Further, an insulating member 14 made of such as epoxy resin covers an outer peripheral portion of the fixed-side shield 12*c* and an area up to a connecting portion to a fixed-side arc shield 13*c* made of an arc-resistant member, the connecting portion being a front end portion facing the movable-side electrode 20.

The fixed-side arc shield 13*c* of the third embodiment is of the same size as the central portion 13*t* of the fixed-side arc shield 13*b* of the second embodiment. The fixed-side shield 12*c* of the third embodiment is covered with the insulating member 14. This enhances insulation properties and makes the attachment of the arc 30 difficult, so that the outer diameter of the fixed-side shield 12*c* can be made small.

Fourth Embodiment

Figures 1, 2, 3, 4:
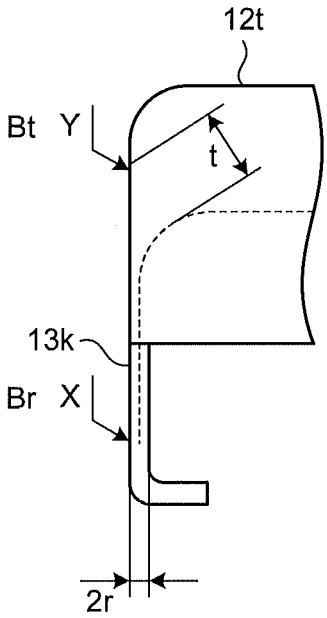
Figure 2:
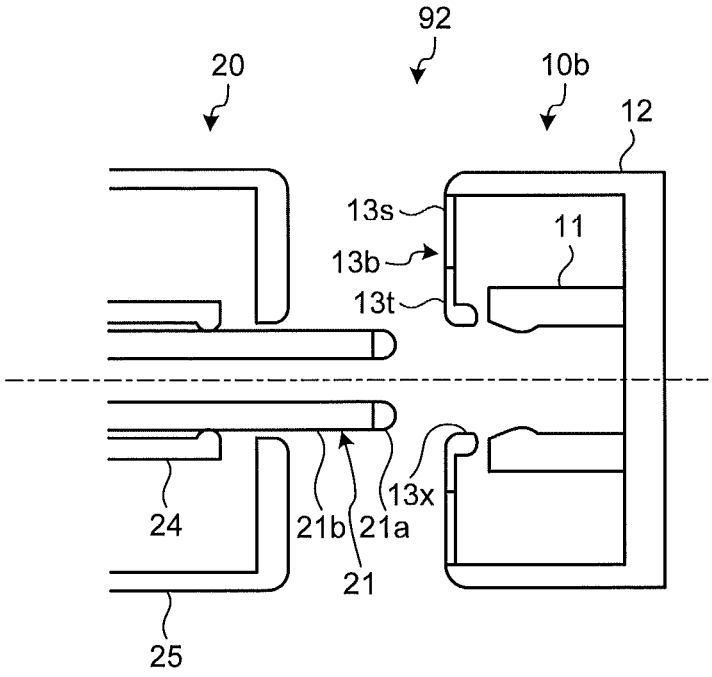
Figure 3:
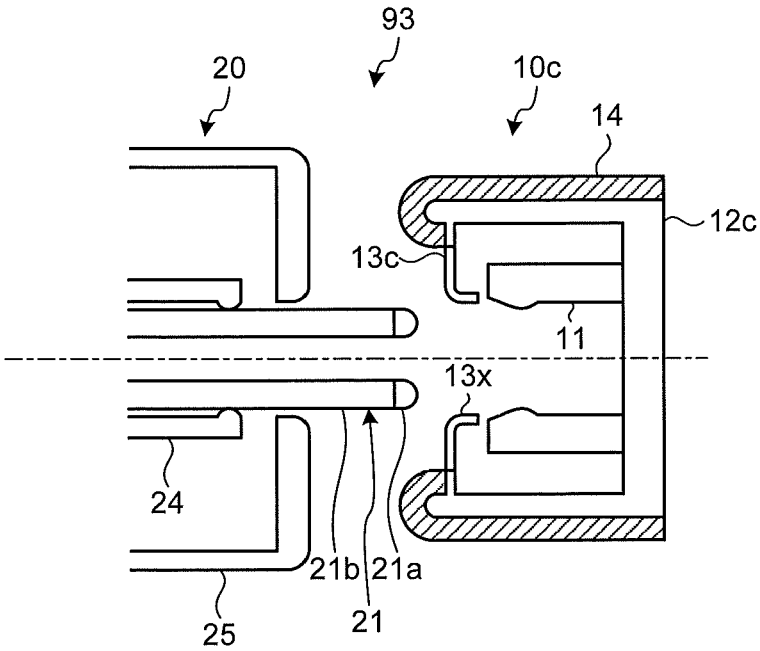
Figure 4:
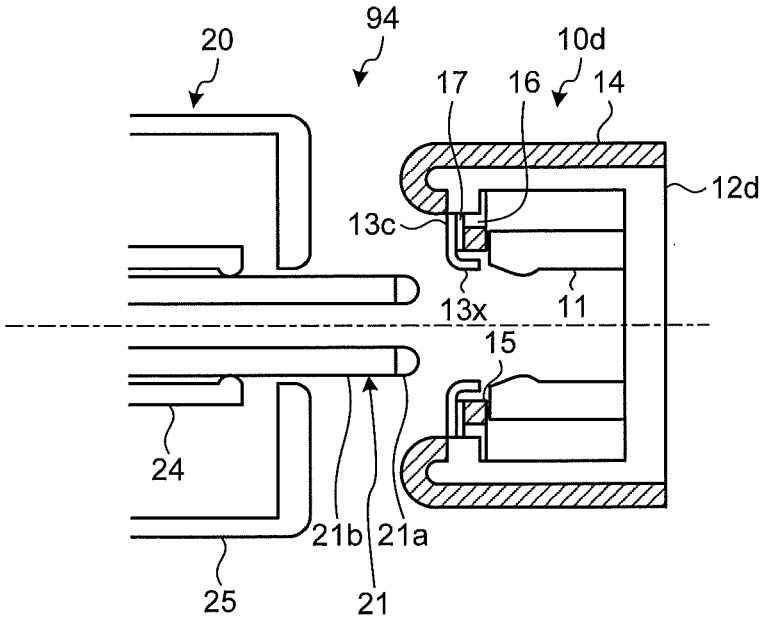

FIG. 4 is a cross-sectional view showing a fourth embodiment of the gas-insulated switchgear according to the present invention. As shown in FIG. 4, a gas-insulated switchgear 94 of the fourth embodiment includes a permanent magnet 15 disposed on the rear side of a fixed-side arc shield 13*c*, which is a different point form the gas-insulated switchgear 93 of the third embodiment. Accordingly, the gas-insulated switchgear 94 does not differ from the gas-insulated switchgear 93 of the third embodiment in other respects.

The annular permanent magnet 15 is disposed on the rear side of the fixed-side arc shield 13*c* of the fourth embodiment in the vicinity of an opening 13*x*. An insulating sheet 17 is placed between the permanent magnet 15 and the fixed-side arc shield 13*c*, and the permanent magnet 15 is fixed with a holding plate 16.

The gas-insulated switchgear 94 of the fourth embodiment includes the permanent magnet 15 disposed in the vicinity of a point where the arc 30 attaches. This allows the arc 30 to rotate in a circumferential direction, so that the arc-extinguishing performance can be enhanced. The presence of the permanent magnet 15 causes the arc 30 to move in the circumferential direction to reduce damage of the fixed-side arc shield 13*c*. Thus, the plate thickness of the fixed-side arc shield 13*c* can be reduced further.

Fifth Embodiment

Figure 5:
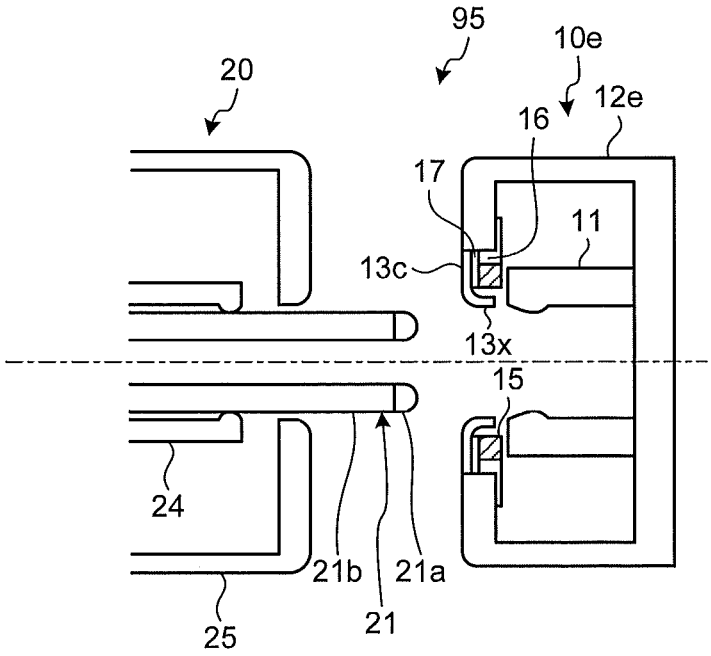
FIG. 5 is a cross-sectional view showing a fifth embodiment of the gas-insulated switchgear according to the present invention.

FIG. 5 is a cross-sectional view showing a fifth embodiment of the gas-insulated switchgear according to the present invention. As shown in FIG. 5, a gas-insulated switchgear 95 of the fifth embodiment includes a fixed-side electrode 10*e* with a fixed-side shield 12*e* having a shape different from that of a fixed-side electrode 10*d* of the fourth embodiment. The gas-insulated switchgear 95 does not differ in other respects.

The fixed-side shield 12*e* of the fifth embodiment is not covered with the insulating member 14. Further, the fixed-side shield 12*e* has an outer diameter larger than that of the fixed-side shield 12*d* of the fourth embodiment, and is the same as that of the fixed-side shield 12 of the first and second embodiments.

The gas-insulated switchgear 95 of the fifth embodiment includes a permanent magnet 15 disposed in the vicinity of a point where the arc 30 attaches. This allows the arc 30 to rotate in a circumferential direction, so that the arc-extinguishing performance can be enhanced. The presence of the permanent magnet 15 causes the arc 30 to move in the circumferential direction to reduce damage of the fixed-side arc shield 13*c*. Thus, the plate thickness of the fixed-side arc shield 13*c* can be reduced further.

Sixth Embodiment

Figure 6:
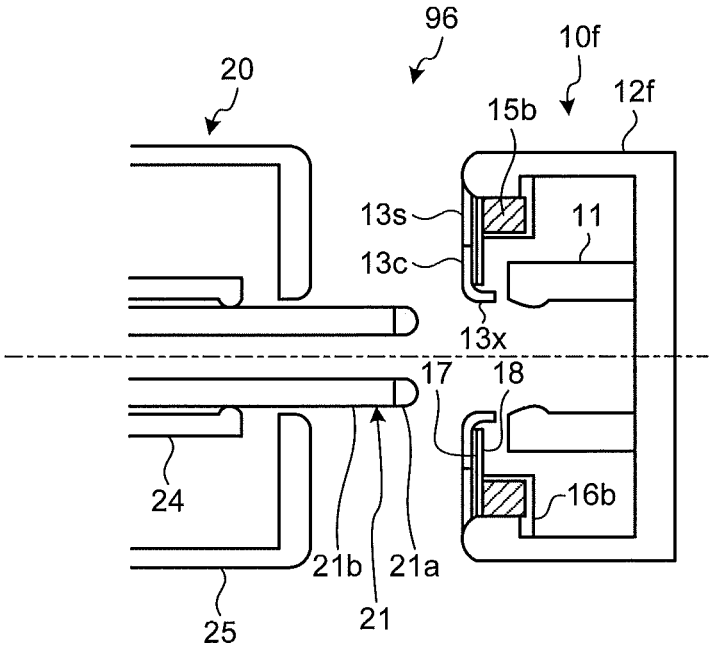
FIG. 6 is a cross-sectional view showing a sixth embodiment of the gas-insulated switchgear according to the present invention.

FIG. 6 is a cross-sectional view showing a sixth embodiment of the gas-insulated switchgear according to the present invention. As shown in FIG. 6, a gas-insulated switchgear 96 of the sixth embodiment includes a fixed-side electrode 10*f*, the shape of which around a permanent magnet 15*b* is different from that of the fixed-side electrode 10*e* of the fifth embodiment. The gas-insulated switchgear 96 does not differ in other respects.

The fixed-side electrode 10*f* of the sixth embodiment includes an insulating sheet 17 and a magnetic body (magnetic plate) 18 disposed between a fixed-side arc shield 13*c* at a central portion and a peripheral portion 13*s*, and the permanent magnet 15*b*.

The gas-insulated switchgear 96 of the sixth embodiment includes the magnetic body 18 disposed between the fixed-side arc shield 13*c* and the peripheral portion 13*s*, and the permanent magnet 15*b*. This allows the permanent magnet 15*b* to be away from the arc 30 without lowering the magnetic flux density near a point where the arc 30 attaches. Thus, thermal influence exerted by the arc 30 on the permanent magnet 15*b* can be reduced.

Seventh Embodiment

Figures 1, 7:
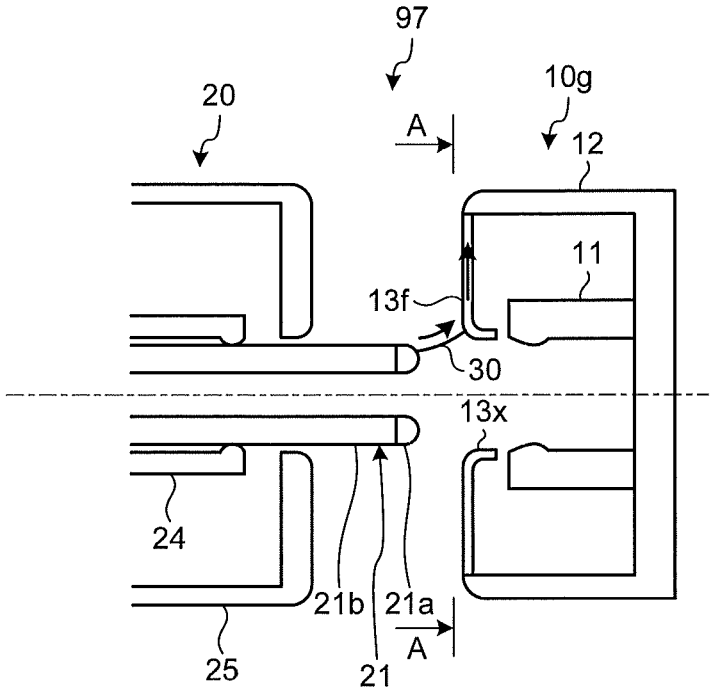
Figures 2, 7:
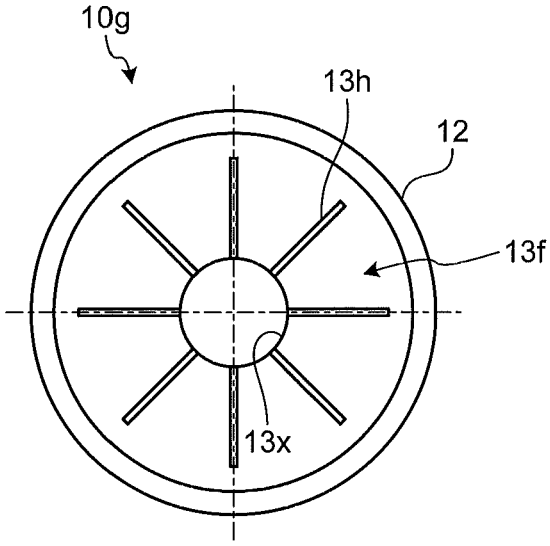

FIG. 7-1 is a cross-sectional view showing a seventh embodiment of the gas-insulated switchgear according to the present invention. FIG. 7-2 is a view from the direction of an arrow along line A-A of FIG. 7-1. As shown in FIGS. 7-1 and 7-2, a gas-insulated switchgear 97 of the seventh embodiment includes a fixed-side electrode 10*g* with a fixed-side arc shield 13*f* having a shape different from that of the fixed-side electrode 10 of the first embodiment. The gas-insulated switchgear 97 does not differ in other respects.

The fixed-side arc shield 13*f* of the seventh embodiment is provided with a plurality of slits 13*h* formed in a radial direction. Provision of the slits 13*h* causes an arc current to flow intensively in the fixed-side arc shield 13*f*, so that the magnetic flux density can be increased in the vicinity of a position where the arc 30 attaches. Thus, the arc 30 is restricted in the vicinity of an opening 13*x*, so that a ground fault of a container can be prevented.

INDUSTRIAL APPLICABILITY

As described above, the gas-insulated switchgear according to the present invention is useful for use in power plants and substations.

REFERENCE SIGNS LIST

10, 10*b*, 10*c*, 10*d*, 10*e*, 10*f*, 10*g* FIXED-SIDE ELECTRODE
11 FIXED-SIDE CONDUCTING CONTACT
12, 12*c*, 12*d*, 12*e*, 12*f* FIXED-SIDE SHIELD
13, 13*b*, 13*c*, 13*f*, 13*j*, 13*k* FIXED-SIDE ARC SHIELD
13*t* CENTRAL PORTION (MADE OF AN ARC-RESISTANT MEMBER)
13*s* PERIPHERAL PORTION
13*x* OPENING
13*h* SLIT
14 INSULATING MEMBER
15, 15*b* PERMANENT MAGNET
16, 16*b* HOLDING PLATE
17 INSULATING SHEET
18 MAGNETIC BODY
20 MOVABLE-SIDE ELECTRODE
21 MOVABLE CONDUCTOR
21*a* MOVABLE-SIDE ARCING CONTACT
21*b* SLIDING CONTACT
24 MOVABLE-SIDE CONDUCTING CONTACT
25 MOVABLE-SIDE SHIELD
30 ARC

The invention claimed is:

1. A gas-insulated switchgear comprising:
a fixed-side electrode including:
a tubular fixed-side conducting contact, and
a fixed-side shield that is disposed radially outward of, and surrounds, the fixed-side conducting contact,
a movable-side electrode including a movable conductor driven by a driving unit to be connected to and separated from the fixed-side conducting contact, and
a fixed-side arc shield in the form of a circular plate thinner than the fixed-side shield, and made of a material different from the material of the fixed-side shield,
the fixed-side arc shield having an opening with a diameter larger than an outer diameter of the movable conductor, the opening being formed on a side of the fixed-side shield facing the movable-side electrode,
the fixed-side arc shield causing an arc current to flow outward in a radial direction during contact parting of the fixed-side conducting contact and the movable conductor to generate magnetic flux on a surface thereof in a circumferential direction that produces a force acted on an arc in a direction of toward a central axis, the fixed-side arc shield containing an arc-resistant member for restricting the arc in the vicinity of the opening.

2. The gas-insulated switchgear according to claim 1, wherein only a central portion of the fixed-side arc shield is made of the arc-resistant member.

3. The gas-insulated switchgear according to claim 1, wherein an insulating member covers an outer peripheral portion of the fixed-side shield and an area up to a connecting portion to the fixed-side arc shield made of the arc-resistant member, the connecting portion being a front end portion facing the movable-side electrode.

4. The gas-insulated switchgear according to claim 3, wherein an annular permanent magnet is disposed on a rear side of the fixed-side arc shield in the vicinity of the opening.

5. The gas-insulated switchgear according to claim 1, wherein an annular permanent magnet is arranged on a rear side of the fixed-side arc shield in the vicinity of the opening.

6. The gas-insulated switchgear according to claim 5, wherein a magnetic body is disposed between the fixed-side arc shield and the permanent magnet.

7. The gas-insulated switchgear according to claim 1, wherein a plurality of slits are formed in a radial direction of the fixed-side arc shield.

8. The gas-insulated switchgear according to claim 1, wherein the fixed-side shield has a cylindrical shape.

9. The gas-insulated switchgear according to claim 1, wherein the fixed-side arc shield is attached to an end of the fixed-side shield facing the movable-side electrode.

* * * * *